United States Patent [19]

Pierce et al.

[11] Patent Number: 4,765,843

[45] Date of Patent: Aug. 23, 1988

[54] PROCESS FOR PREVENTING CONTAMINATION OF REAGENT SYSTEMS

[75] Inventors: Sue K. Pierce, Arlington; Jack B. Robinson, Jr., Duncanville; Ruth R. Scoggin, Haltom City, all of Tex.

[73] Assignee: Abbott Laboratories, Abbott Park, Ill.

[21] Appl. No.: 43,513

[22] Filed: Apr. 28, 1987

[51] Int. Cl.[4] ..... B08B 17/02

[52] U.S. Cl. ..... 134/22.14; 134/22.19; 134/26; 252/174.15

[58] Field of Search ..... 134/22.14, 22.19, 26; 252/174.15

[56] References Cited

U.S. PATENT DOCUMENTS

| | | | |
|---|---|---|---|
| 2,681,122 | 8/1972 | Domicone et al. | 134/22.14 |
| 2,978,387 | 4/1961 | Chapman et al. | 134/22.19 |
| 3,615,826 | 10/1971 | Brill et al. | 134/22.19 |
| 4,222,886 | 9/1980 | Connelly, Jr. | 134/22.14 |

FOREIGN PATENT DOCUMENTS

| | | | |
|---|---|---|---|
| 0200682 | 8/1981 | Fed. Rep. of Germany | 134/22.19 |

*Primary Examiner*—Asok Pal

*Attorney, Agent, or Firm*—Dennis K. Shelton; Martin L. Katz

[57] ABSTRACT

A process for preventing contamination of a reagent system by a reagent delivery system. The process is suitable for performing an iron determination of a sample which prevents iron contamination of the sample from metal or iron-containing surfaces contained within the apparatus used to perform the iron assay. The process comprises pretreatment of the reagent delivery system surfaces with a silane solution and then washing the pretreated surfaces with water to remove any excess silane solution. Generally, the silane solution is an organosilane solution which can be an emulsion.

13 Claims, No Drawings

PROCESS FOR PREVENTING CONTAMINATION OF REAGENT SYSTEMS

BACKGROUND OF THE INVENTION

The present invention is directed toward a process for preventing contamination of a reagent system. The process is especially suitable for performing iron determinations where iron contamination would lead to false results. The process comprises the pretreatment of the reagent delivery system with an organosilane solution to form a protective coating whereby contamination of the reagent system is prevented. Excess organosilane solution is then washed from the reagent delivery system prior to being contacted with the reagent system.

A common characteristic of many reagent systems is that they require a low pH, acidic environment. The acidic nature of these reagent systems can attack the surfaces of reagent delivery system to release various contaminants. This is especially true for iron reagent systems where an acidic environment is required to release the iron from the transferrin such that the chromogen can form a colored reaction product with the liberated iron. The acidic characteristic of the various iron reagent systems creates a serious problem when attempting to perform an iron determination with an apparatus that contains iron-containing surfaces, or when employing a reagent delivery system that contains iron-containing surfaces. For example, when a probe is used to apply a reagent which has a stainless steel needle or where an automated apparatus has stainless steel valves or pipettes, the reagent system, because of its acidic nature, causes iron to be leached out which contaminates the specimen and causes erroneously high iron measurements.

Several approaches have been attempted to solve this problem. One such approach is to manually dispense all the reagents into the specimen. However, this is not practical in attempting to assay numerous specimens. In another approach, the apparatus for performing an iron assay is first pretreated with a sucrose buffer. Unfortunately, sucrose pretreatment requires dedicated equipment and treatment with every run. In yet another approach, the apparatus for performing the iron determination can have all the metal parts replaced with plastic parts; however, this is generally not feasible or desirable for the operation of the apparatus. Therefore, it is desirable to develop a process whereby an iron determination or any other assay can be performed on an apparatus containing metal parts or having iron-containing surfaces which does not contaminate the reagent system and therefore introduce error into the determination.

SUMMARY OF THE INVENTION

In one aspect, the present invention is directed toward a process for preventing contamination of a reagent system by a reagent delivery system. The process comprises pretreatment of the reagent delivery system with a silane solution and washing the reagent delivery system to remove excess silane solution whereby contamination of the reagent system is prevented. The silane solution is typically an organosilane solution which can be an emulsion.

In another aspect, the present invention is directed toward a process for performing an iron determination of a sample which employs a reagent system comprising an acidic buffer, a reducing agent and a chromogen wherein contamination of the reagent system by iron is prevented. The process comprises pretreatment of the iron-containing surfaces which the reagent system contacts with a solution of an organosilane compound and washing the pretreated iron-containing surface to remove any excess organosilane solution.

DETAILED DESCRIPTION OF THE INVENTION

The present invention is directed toward a process for preventing contamination of a reagent system by an apparatus employed to perform the assay. The process generally entails pretreatment of the apparatus with a silane solution. The silane solution is generally an organosilane solubilized in an organic solvent. The organosilane solution can be diluted with water to form an emulsion of the desired concentration appropriate for coating the reagent delivery system surfaces of the apparatus employed to perform the assay. Suitable organosilane compositions are chlorotrimethyl silane in methyl choroform and Prosil-28, which is an organosilane ($C_{18}$ alkoxy silane) concentrate commercially available from SCM Chemicals, Gainesville, Fla.

The organosilane solution is employed to coat the surfaces of the reagent delivery system, especially any iron-containing surfaces, to make them inert to subsequent application of a reagent system. An iron-containing surface can be any metallic surface such as stainless steel or steel.

For purposes of describing this process reference is made to an iron reagent system where iron contamination is a most critical problem; however, the process is equally applicable to other reagent systems where contamination by the reagent delivery system is undesirable.

One of the most important trace metal determinations in clinical laboratories is that of iron in serum. The most commonly used reagent systems employ an acidic buffer, a reducing agent and a chromogen. The acidic buffer has a low pH, approximately 4.5, to release the iron from transferrin. Transferrin is a naturally occurring compound in blood serum which contains the iron to be quantified. The released iron is then converted from ferric to ferrous iron with a reducing agent such as hydroxylamine, ascorbic acid or thioglycolic acid. Under acidic conditions, the chromogen generates a color in the presence of the ferrous iron such that the quantity of iron in the serum may be determined. Typical chromogens for serum iron determination are bathophenanthroline sulfonate, tripyridyl triazine, Ferrozine® a registered trademark of Hach Chemical Co., Ames, Iowa and Ferene® a registered trademark of Diagnostic Chemical Ltd., Monroe, Conn.

A typical iron reagent system can also include a compound to minimize copper interference, and a detergent to minimize turbidity.

When the reagent system is brought into contact with iron-containing surfaces, the low pH attacks the surfaces to extract iron. This iron then introduces error into the serum specimen by artificially increasing the iron content. This phenomena, however, can be avoided if the iron-containing surfaces of the apparatus is first pretreated with an organosilane solution.

The organosilane solution is applied to the surfaces of the reagent delivery system, specifically the iron-containing surfaces, in an amount sufficient to form a microscopic coating or film. After pretreatment of the reagent delivery system with the organosilane solution, the reagent delivery system is washed to remove any excess organosilane solution. The excess organosilane solution is removed to prevent any silane contamination of the reagent system. It has been found that when the excess organosilane solution is not washed from the reagent delivery system, the excess silane will precipitate in the presence of low pH buffer and cause turbidity, making measurement of the chromogen difficult.

The wash is generally conducted by washing the reagent delivery system with purified water, distilled or deionized water, buffer or other liquids not reactive with the organosilane solution. The quantity of wash is dependent on the design of the reagent delivery system, i.e., volume, dead space, etc. Generally a wash several times the reagent delivery system volume is used to effectively wash excess organosilane solution from the reagent delivery system.

After the pretreatment of the reagent delivery system with the organosilane solution and the subsequent washing of the excess organosilane solution from the system, the reagent system may be employed. Generally, more than one assay can be run after the organosilane pretreatment. However, repeated use of the apparatus will eventually remove the microscopic organosilane film from the reagent delivery system's surfaces. Therefore it is desirable to run blanks from time to time to determine whether any contamination from the apparatus is taking place. Blanking is generally conducted by running an assay on a sample of distilled or deionized water, thus any positive results observed with the distilled water sample would indicate contamination from the system.

It has been observed that the deposited organosilane film does not interfere with an iron reagent. That is, even though the organosilane coating which is deposited on the reagent delivery system's surfaces is eventually removed by the reagent system, these minimal amounts of silane do not affect the accuracy of the iron assay. It has also been established that the silane treatment does not interfere with other common clinical chemistry reagents.

A standard method for performing the subject organosilane pretreatment of an apparatus employed to perform an assay is to first run an aliquot of organosilane solution through the apparatus to form an organosilane coating on the surfaces. A sufficient amount is considered to be an amount appropriate to provide a microscopic coating or film to the surfaces such that the reagent system does not leach chemicals or, more specifically, iron from the iron-containing surfaces. This quantity can vary from system to system depending on the amount of contaminate contributing surfaces encountered by the reagent system.

After treating the apparatus with the organosilane solution, the apparatus is washed to remove any excess organosilane solution. This is to prevent silane from entering into the reagent system. While the silane does not generally interfere with a reagent system's ability to perform properly, excess silane can precipitate in the low pH buffer to cause turbidity which interferes with the optical quantification of a specimen. After washing the apparatus, the assay is run until the microcoating of organosilane is removed, which is identified by the performance of calibrations and random blanks.

It is recommended that calibrations be performed daily before running any assay determinations. For example, calibration for an iron determination refers to running samples of known iron content to establish the response per concentration unit. Calibration often includes a blank which is a sample (generally distilled water) with no iron present. For instance, the organosilane pretreatment was performed on the Abbott VP Super System® instrument (commercially available from Abbott Laboratories, North Chicago, Ill.) where up to 180 separate iron determinations could be run prior to the necessity to perform an additional organosilane pretreatment. Generally, 180 tests would not be performed in a typical clinical setting and therefore, a single pretreatment step performed daily can provide adequate protection from contamination of the specimen. However, it is recommended that frequent calibrations and blanks be performed to assure that no contamination of the reagent system is occurring.

The following examples are provided to further illustrate the improved process for performing assays of samples which prevents contamination from the apparatus employed. For purposes of demonstration the examples are directed toward iron assays where contamination by iron-containing surfaces generally present in a reagent delivery system is easily detected.

EXAMPLE I

Blank samples of distilled water were tested for iron content in order to determine the amount of iron contribution from an automated apparatus before and after the silane pretreatment. The apparatus employed was an Abbott VP Super System® which contains stainless steel valves, probe and syringe components in the reagent delivery system. The reagent system comprised an acetate buffer solution at a pH of 4.5 containing hydroxylamine hydrochloride to reduce the iron and an acetate buffer solution at a pH of 4.5 containing a chromogen (Ferene® a trademark of the Diagnostic Chemicals Ltd., Monroe, Conn.) to color the reduced iron for detection. For this test the first five blank samples were run on an apparatus without any pretreatment. Subsequently the silane pretreatment step was performed. In the pretreatment steps approximately 14 ml of a silane-solution comprising 1% Prosil-28 in distilled water was pumped through the reagent delivery system and then approximately 28 ml of distilled water was pumped through the reagent delivery system.

The Abbott VP Super System® test tray can accommodate up to 31 samples. For this test the first five positions were filled with distilled water and the iron assay reagent system was loaded into the apparatus. Theoretically, all the tests should have been negative for iron content. The results were as shown below.

| Water Sample | No pretreatment Iron μg/dl | Silane pretreatment Iron μg/dl |
|---|---|---|
| 1 | 96 | −3 |
| 2 | 30 | 0 |
| 3 | 9 | 0 |
| 4 | 0 | 3 |
| 5 | 0 | 3 |

The results show that the initial water samples tested without a silane pretreatment had erroneous iron content due to contamination from the apparatus reagent delivery system. The last two samples tested accurately because the continuous testing of the five samples gradually cleaned the reactive iron compounds from the reagent delivery system. The silane pretreatment step significantly lowered any iron contribution from the reagent delivery system. The −3 and 3 μg/dl are insignificant levels considering the normal range of iron found in blood serum is from about 50 to about 150 g/dl.

EXAMPLE II

The iron determination of serum samples was conducted on an Abbott VP Super System® apparatus using the same reagent system of Example I. The serum samples were predetermined to contain 103 and 204 μg/dl of iron. Two aliquots of each sample were then placed in the automated apparatus and tested. Testing was performed twice, once without a pretreatment and then with a silane pretreatment step. The results are shown below.

| Sample | No pretreatment Iron μg/dl | Silane pretreatment Iron μg/dl |
|---|---|---|
| A (103 g/dl) | −10 | 98 |
| | −10 | 103 |
| B (204 g/dl) | 152 | 201 |
| | 147 | 201 |

The very low and erroneous results for the non-pretreatment tests are a result of the automated apparatus substracting out iron content measured in a distilled water calibration step which is automatically performed by the apparatus. The results show that where the silane pretreatment step was performed the analysis results are quite close to the established values which indicates that there was no iron contamination of the reagent system.

We claim:

1. A process for preventing contamination of a reagent for delivery by a reagent delivery system wherein said process comprises:

pretreatment of said reagent delivery system with a silane solution, and washing said pretreated reagent delivery system to remove excess silane solution, whereby contamination of said reagent is prevented.

2. The process of claim 1 wherein said solution of silane is an organosilane dissolved in an organic solvent and diluted with water.

3. The process of claim 2 wherein said solution of silane is Prosil-28.

4. The process of claim 1 wherein a calibration step is performed to determine any contamination of said reagent.

5. The process of claim 1 wherein said washing step is conducted with distilled or deionized water.

6. The process of claim 1 wherein said reagent system is an iron reagent.

7. The process of claim 6 wherein said iron reagent comprises an acidic buffer, reducing agent and chromogen.

8. The process of claim 6 wherein said reagent delivery system has iron-containing surfaces whereby the iron contamination of said reagent is prevented.

9. A process for preventing contamination of a reagent for delivery by a reagent delivery system wherein said process comprises:

pretreatment of said reagent delivery system with a silane solution of an organosilane dissolved in an organic solvent and diluted with water, and washing said pretreated reagent delivery system to remove excess silane solution, whereby contamination of said reagent is prevented.

10. The process of claim 9 wherein said silane solution is Prosil-28.

11. The process of claim 9 wherein a calibration step is performed to determine any contamination of said reagent.

12. The process of claim 9 wherein said washing step is conducted with distilled or deionized water.

13. The process or claim 9 wherein said reagent is an iron reagent.

* * * * *

UNITED STATES PATENT AND TRADEMARK OFFICE

CERTIFICATE OF CORRECTION

PATENT NO. : 4,765,843

DATED : August 23, 1988

INVENTOR(S) : Sue K. Pierce, Jack B. Robinson, Jr., Ruth R. Scoggin

It is certified that error appears in the above—identified patent and that said Letters Patent is hereby corrected as shown below:

Column 6, line 14: Change --reagent system-- to "reagent"

Signed and Sealed this

Tenth Day of January, 1989

*Attest:*

DONALD J. QUIGG

*Attesting Officer*

*Commissioner of Patents and Trademarks*